US005810019A

United States Patent [19]

Beard et al.

[11] Patent Number: 5,810,019

[45] Date of Patent: Sep. 22, 1998

[54] PROCESS AND APPARATUS FOR TOBACCO BATCH PREPARATION AND EXPANSION

[75] Inventors: Hoyt Sturdivant Beard; Denise Fox, both of Winston-Salem; Robert Calvin Johnson, Advance; James Edward Lovette; Franklin Allan Stump, Jr., both of Winston-Salem, all of N.C.

[73] Assignee: R.J. Reynolds Tobacco Company, Winston-Salem, N.C.

[21] Appl. No.: 759,389

[22] Filed: Dec. 4, 1996

Related U.S. Application Data

[62] Division of Ser. No. 500,006, Jul. 10, 1995, Pat. No. 5,657,771.

[51] Int. Cl.[6] ..... A24B 3/18

[52] U.S. Cl. ..... 131/291; 131/196

[58] Field of Search ..... 131/291, 296, 131/290, 108, 304, 306

[56] References Cited

U.S. PATENT DOCUMENTS 3,693,631 9/1972 Moore et al. ..... 131/296

*Primary Examiner*—John G. Weiss
*Assistant Examiner*—Charles W. Anderson

[57] ABSTRACT

A tobacco expansion process and apparatus is provided to form a tobacco batch having a predetermined amount of tobacco, contact the batch with steam, load the batch onto a spool assembly, and impregnate the batch with an expansion agent. A double conduit apparatus is provided to load two simultaneously formed tobacco batches onto opposing sides of the impregnation spool. The tobacco batch is formed within a batch forming chamber comprising a vertically adjustable screen to accommodate different operating parameters and/or different tobacco types and/or forms. The batch is directed through a pneumatically separable zone to a precompaction and heating zone. The separable zone is defined by sequentially operating members, at least two of which form barriers to impede seepage of the expansion agent from the impregnating zone. In the precompaction zone the batch is precompacted against a permeable barrier, steamed, and then loaded onto a spool assembly for impregnation with an expansion agent.

12 Claims, 6 Drawing Sheets

PROCESS AND APPARATUS FOR TOBACCO BATCH PREPARATION AND EXPANSION

This application is a divisional of application Ser. No. 08/500,006, filed Jul. 10, 1995 now U.S. Pat. No. 5,657,771.

FIELD OF THE INVENTION

The invention relates to processes and apparatus for the preparation, treatment and infeed of tobacco batches particularly in association with tobacco batch expansion processes. The invention also provides processes and apparatus for enhancing tobacco expansion.

BACKGROUND OF THE INVENTION

In the past two decades, tobacco expansion processes have become an important part of the cigarette manufacturing process. Tobacco expansion processes are used to restore tobacco bulk and volume which are lost during curing and storing tobacco leaf. Tobacco expansion processes are also used to increase the bulk of cured tobacco above that of the tobacco leaf in order to lower the "tar" and nicotine content of many cigarette products including low tar and ultra-low tar cigarettes.

Tobacco expansion processes involving contacting of tobacco with an impregnant followed by rapid heating to volatilize the impregnant and thereby expand the tobacco, are described in U.S. Pat. No. 3,524,451 to Fredrickson et al. and U.S. Pat. No. 3,524,452 to Moser et al. A process employing a vapor state impregnation of tobacco followed either by heating or rapid pressure reduction for tobacco expansion is disclosed by U.S. Pat. No. 3,683,937 to Fredrickson et al.

Carbon dioxide has been used in tobacco expansion processes as disclosed in U.S. Pat. No. 4,235,250 to Utsch; U.S. Pat. No. 4,258,729 to Burde et al.; and U.S. Pat. No. 4,336,814 to Sykes et al., among others. In these and related processes, tobacco is impregnated with carbon dioxide, either in gas or liquid form, and the impregnated tobacco is subjected to rapid heating conditions for expansion. These known carbon dioxide expansion processes, however, require excessive heating of the impregnated tobacco in order to achieve substantial and stable expansion. This excessive heating can harm the tobacco flavor and/or generate an excessive amount of tobacco fines. In addition, those processes which use liquid carbon dioxide for impregnating tobacco often result in impregnated tobacco in the form of solid tobacco blocks containing dry ice which must then be broken up prior to heat treatment. This can harm the tobacco and also increases the complexity and cost of the expansion process.

U.S. Pat. No. 4,531,529 to White and Conrad describes a process for increasing the filling capacity of tobacco, in which tobacco is impregnated with a low boiling, highly volatile expansion agent, such as a normally gaseous halocarbon or hydrocarbon, at process conditions above or near the critical pressure and temperature of the expansion agent. The pressure is quickly reduced resulting in expansion of the tobacco without the necessity of a heating step to either expand the tobacco or fix the tobacco in the expanded condition. The pressure conditions of this process range from 36 $Kg/cm^2$ (512 psi) and higher with no known upper limit. Pressures below 142 $Kg/cm^2$ (2000 psi) were used to produce satisfactory tobacco expansion without excessive fracturing. Normally gaseous hydrocarbons such as methane, ethane, and propane, are among the preferred impregnants used in this process.

U.S. Pat. No. 4,554,932 to Conrad and White describes a fluid pressure treating apparatus including a tubular shell housing a spool assembly. The spool includes a cylindrical body portion of relatively small diameter that extends between the two spool ends, which have a diameter greater than the spool body, but less than the diameter of the shell. The spool is mounted within the shell for reciprocating movement between a loading position outside the shell, a treating position within the shell, and an unloading position outside of the shell. When the spool is within the shell, deformable sealing rings carried in annular grooves on the cylindrical ends of the spool are forced radially outwardly for engagement with the interior of the shell. This provides a sealed, annular-shaped pressure chamber inside the shell, in the space between the spool ends surrounding the smaller spool body. One or more ports through the shell cooperate with conduit shaped cavities-extending radially into the spool ends and axially along the spool body to allow input and removal of processing fluids into and from the annular space around the spool body within the shell. The use of this apparatus for high pressure impregnation of tobacco with an expansion agent permits rapid loading and unloading of tobacco and avoids the closure and opening problems associated with conventional pressure sealing and locking mechanisms, such as the pivoting autoclave lids of conventional pressure vessels. The spool and shell pressure vessel can thus produce time savings and improve economics in tobacco expansion.

Tobacco expansion processes, including those described above and others, must be conducted in batch processes when impregnation pressures substantially exceed atmospheric pressure. In order to achieve efficient and repeatable tobacco expansion in such batch processes, it is necessary to repeatedly form tobacco batches of a precise size based on the interior volume of the pressure treating vessel and/or density and expansion characteristics associated with the type of tobacco being expanded. Typically, design of the batch forming process is constrained by other manufacturing considerations associated with tobacco expansion processes including the desire to minimize leakage of volatile tobacco expansion agent as the tobacco is formed into batches and then fed and loaded into a pressure vessel for impregnation.

SUMMARY OF THE INVENTION

This invention provides processes and apparatus for forming, feeding, and treating tobacco batches in connection with tobacco expansion processes and other tobacco processing operations. The invention also provides tobacco expansion apparatus and processes that can be employed for expanding tobacco at rapid throughput rates employing high pressure tobacco impregnation conditions, and flammable, gaseous expansion agents.

The apparatus and processes of this invention are particularly useful in conjunction with the processes and apparatus of U.S. patent application Ser. No. 08/076,535, filed Jun. 14, 1993, by Lucas J. Conrad and Jackie L. White, which provides for dramatically improving tobacco throughput in high pressure tobacco impregnation systems; and U.S. patent application Ser. No. 08/163,149 filed Dec. 6, 1993, by Hoyt S. Beard et al, which provides various tobacco batch forming and feeding processes and apparatus, and other improvements in high throughput tobacco expansion processes. The processes and apparatus of these applications typically involve tobacco impregnation and expansion cycle times less than 20 to 30 seconds; the use of pre-heated, high pressure expansion agents such as propane; the use of an increased moisture content, pre-heated tobacco feed; and/or the compression of tobacco within a high pressure impregnation vessel for greatly improving use of available space in the impregnation vessel.

In accordance with the present invention it has been found that tobacco batch forming and feeding steps, particularly in preferred embodiments of the above-identified Conrad et al, and Beard et al applications, present unforeseen difficulties which can be particularly severe because of the rapid rate at which consistent sized tobacco batches must be formed and fed to an impregnation zone. In practice, it has been found that tobacco pre-heating and moisturization unexpectedly complicate high speed tobacco batch forming and feeding steps because the tobacco forms clumps under these conditions resulting in a tobacco feed stream of non-uniform density. Additionally, it has been found that heating of the moistened tobacco releases and/or softens various natural tobacco gums and resins which further complicates the clumping problem and interferes with transfer of the tobacco from one location to another since the tobacco tends to adhere to processing equipment. These difficulties not only interfere with the batch forming steps, but can also result in blockage of the tobacco infeed apparatus in some cases. In those expansion processes which use flammable, gaseous expansion agents like propane, overcoming of the clumping problem is further aggravated by the need for process and apparatus controls that ensure safe operation of the process.

In one aspect, the present invention provides tobacco batch forming and feeding systems for reliably and economically forming and feeding tobacco batches of predetermined size to a downstream operation, preferably a tobacco impregnation operation. This apparatus includes a tobacco batch forming chamber defined in part by a substantially vertical inlet wall and a substantially vertical, abutment wall, which is horizontally spaced from the inlet wall. An inlet port through the inlet wall is positioned to admit tobacco into the chamber in a direction transverse to the abutment wall. A pneumatic conveyor is connected to the inlet for supplying tobacco to the inlet at a flow rate sufficient to cause the tobacco to accumulate against the abutment wall. A screen is positioned in an upper portion of the chamber to allow escape of pneumatic transport gas associated with the incoming tobacco while providing an upper barrier to prevent escape of tobacco from the chamber. A sensor is operatively associated with the chamber for determining when a predetermined amount of tobacco has accumulated horizontally against the abutment wall. The screen is moveable between at least two vertical positions to vary the volume of the tobacco batch forming chamber. Preferably the bottom wall of the chamber is formed at least in part by a closure member arranged to pivot downwardly for controlled release of the tobacco batches through the bottom of the chamber.

This apparatus avoids use of moving parts for conveying the tobacco, and for separating the tobacco into discrete batches, and thus minimizes problems associated with tobacco clumping including lack of uniformity in the density of tobacco feed, difficulties associated with detangling of individual tobacco clumps, etc. The apparatus can rapidly and economically provide tobacco batches of consistent, predetermined size, but can readily be adjusted to change the size of the tobacco batches in response to process variations or variations in the nature or density of the tobacco feed.

In another aspect, the present invention provides an apparatus and process for transferring a tobacco batch to an impregnation zone while minimizing escape of the tobacco expansion agent from the impregnation zone into the tobacco feed. The apparatus includes a tobacco batch forming chamber, preferably of the type described above. The batch forming chamber is defined in part by a chamber closure member arranged for movement between a closed position in which the closure member forms at least a portion of a bottom wall of the chamber and an open position in which the closure member defines a port in a lower portion of the chamber to release tobacco batches from the chamber. A vertically oriented tobacco delivery conduit is located below the batch forming chamber and includes a separable zone between the chamber closure member and a conduit closure member positioned below the chamber closure member. The conduit closure member is arranged for movement between a closed position defining a substantial seal in the conduit and an open position defining an opening in the conduit. An inert gas supply communicates with the separable zone in the vertical conduit to supply inert gas into the zone.

The separable zone in the vertical tobacco delivery conduit provides a gas barrier that prevents any substantial amount of impregnation gas from traveling upwardly through the tobacco delivery conduit and into the batch forming chamber thereby contaminating the pneumatic supply system. In operation, the conduit closure member is maintained in the closed position when the chamber closure member is opened for delivery of a tobacco batch into the conduit. The conduit closure member receives and supports the tobacco batch delivered from the batch forming chamber. When the chamber closure member is returned to its closed position, the conduit closure member is opened to release the tobacco batch into a lower portion of the conduit. The conduit closure member is then returned to its closed position while the chamber closure member is maintained in its closed position to thereby substantially isolate the separable zone pneumatically from the tobacco batch forming chamber and from the lower portion of the tobacco delivery conduit. The inert gas supply in the separable zone admits inert gas into the pneumatically isolated zone so that when the chamber closure member is subsequently opened for delivery of another tobacco batch into the vertical conduit, any gasses which might escape into the batch forming chamber are primarily purge gasses.

In still another aspect, the present invention simplifies and improves the process for expansion of uniform batches of heated, moistened tobacco. In accord with this aspect of the invention, a batch having a predetermined size is formed from tobacco having a moisture content above about 12% by weight. The preformed batch of moistened tobacco is then contacted with steam to substantially increase the temperature and moisture of the tobacco batch. The heated and moistened tobacco batch is then loaded into an impregnation zone and impregnated with expansion agent. Preferably the impregnation zone is defined by a spool and shell apparatus, and steaming of the preformed tobacco batch is carried out at a location closely adjacent the impregnation zone. In accordance with this aspect of the invention, it has been found that by separately forming batches of moistened tobacco and thereafter heating the individual batches, the problems associated with release and softening of natural tobacco gums can be substantially avoided. Moreover, it has been found that direct steam contact can uniformly heat individual tobacco batches extremely rapidly, e.g., in a matter of seconds or less, while also increasing the tobacco moisture level. In addition, temperature variations between individual tobacco batches can be minimized by the rapid heating of the individual tobacco batches at a location close to the impregnation zone, in turn providing more uniform tobacco expansion.

Yet another aspect of the present invention provides a precompaction zone for heating and steaming the tobacco batch. In this aspect a tobacco batch is delivered into a first portion of a horizontally extending conduit. A permeable barrier is operatively connected with the conduit for movement between a retracted position outside of the conduit and a barrier position within and extending across the conduit at a location between the first end and a second end of the conduit. A loading member is arranged to move individual tobacco batches along adjacent first and second paths within the horizontal conduit. The first path extends between the first end portion of the conduit and a precompaction position spaced longitudinally from the barrier position; the second path extends from the precompaction position to a position adjacent the second end of the conduit. A tobacco precompaction zone is defined in the conduit between the precompaction position and the barrier position, and at least one aperture is provided through a wall of the conduit in the precompaction zone and communicates with a source of steam for heating tobacco in the precompaction zone. Preferably, the tobacco precompaction zone is positioned closely adjacent a loading position at which the tobacco batch is subsequently loaded into an impregnation apparatus. The use of a tobacco batch precompaction zone in accord with this aspect of the invention allows the rapid preparation and feeding of tobacco batches having optimum moisture content and temperature thus enhancing throughput and process economies.

The various aspects of the invention can be used independently or in combination. In preferred embodiments, wherein the various aspects are used in combination with a tobacco batch impregnating and expansion system, the processes and apparatus of the present invention can provide a profoundly effective system for sizing, heating, feeding and expanding tobacco to thereby provide significant advances in tobacco throughput and tobacco expansion economies.

BRIEF DESCRIPTION OF THE DRAWINGS

In the drawings which form a portion of the original disclosure of the invention.

DETAILED DESCRIPTION OF THE PREFERRED EMBODIMENTS

Figure 1:
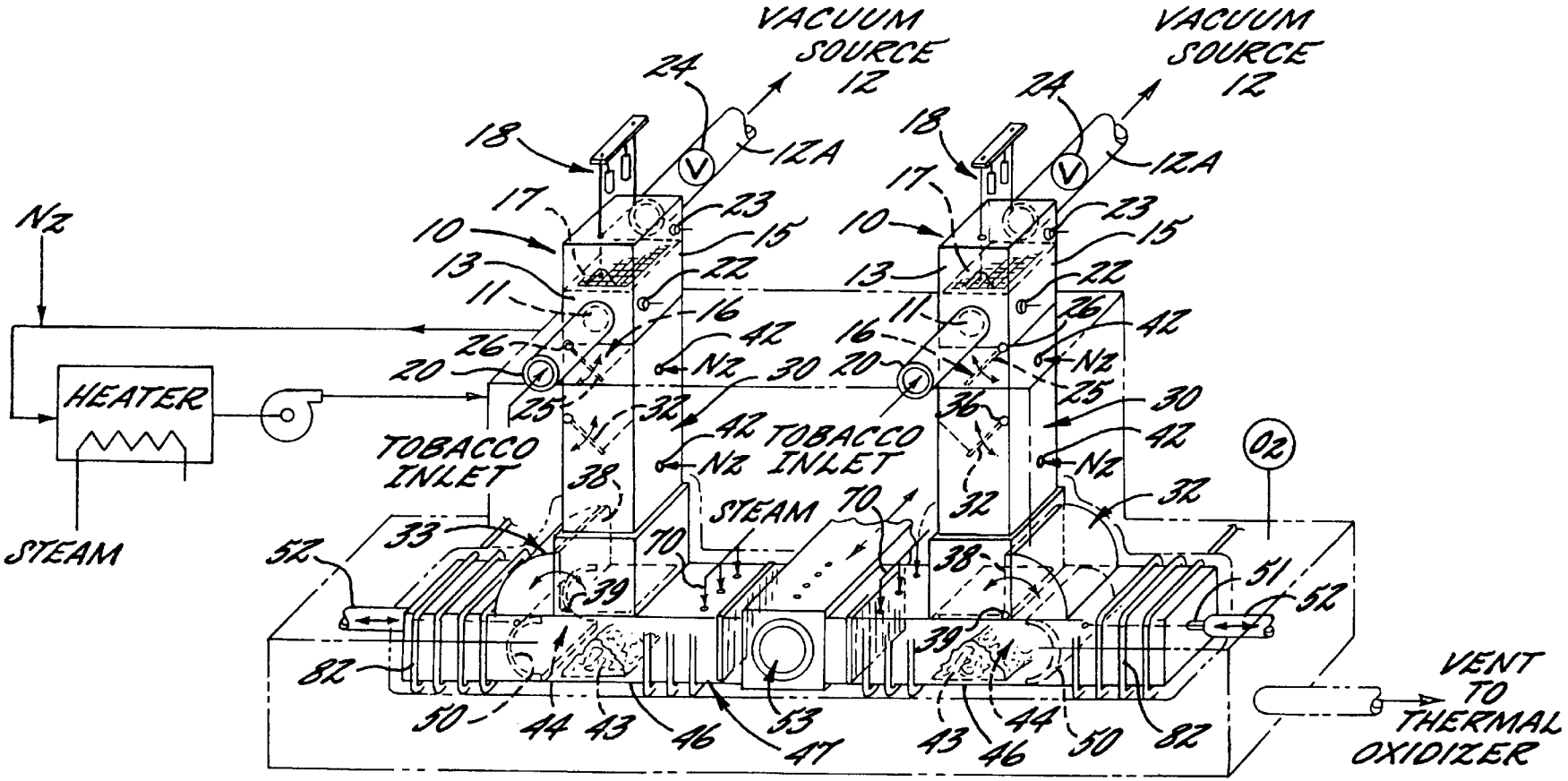
FIG. 1 is a schematic view, in perspective, of a preferred tobacco batch sizing, feeding and heating apparatus of the present invention in which two separate tobacco batch forming, feeding and heating systems are provided for simultaneously preparing and loading two preheated and premoistened tobacco batches onto a reciprocating spool body.

Preferred process and apparatus embodiments of the invention are set forth below. While the invention is described with reference to specific processes and apparatus, including those illustrated in the drawings, it will be understood that the invention is not intended to be so limited. To the contrary, the invention includes numerous alternatives, modifications, and equivalents as will become apparent from a consideration of the foregoing discussion and following detailed description.

FIG. 1 schematically illustrates preferred impregnation processes and apparatus of the invention, including a spool and shell apparatus generally constructed in accordance with U.S. Pat. No. 4,554,932, issued Nov. 26, 1985 to Conrad and White; copending U.S. patent application Ser. No. 08/076,535 of Conrad and White, filed Jun. 14, 1993; and copending U.S. patent application Ser. No. 08/163,048 of Beard et al., filed Dec. 6, 1993, the entire disclosures of which are hereby incorporated by reference. Various details disclosed in the '932 patent, and the '535 and '048 copending applications, are not repeated here for the sake of brevity. However, reference may be had to the '932 patent and the copending patent applications for such details.

The spool and shell assembly detailed in the above '932 patent and copending applications includes a tubular shell housing a spool assembly. The spool includes a cylindrical body portion of relatively small diameter that extends between the two spool ends, which have a diameter greater than the spool body, but less than the diameter of the shell. The spool is mounted within the shell for reciprocating movement between a loading position outside the shell, a treating position within the shell, and an unloading position, also outside of the shell. While in the loading position, the spool is preferably loaded with tobacco on both of its opposing sides.

Figure 2:
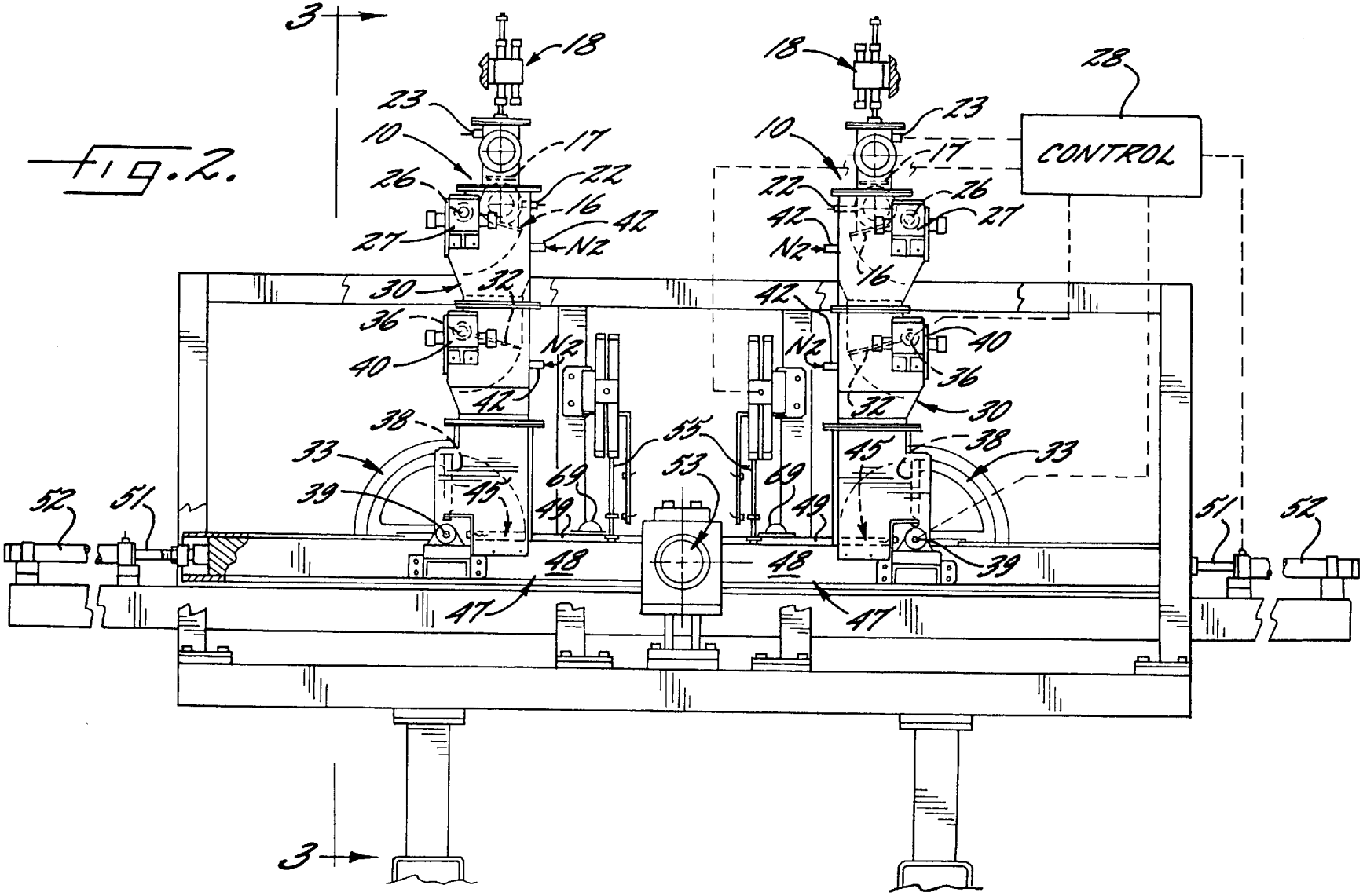
FIG. 2 is a front elevation view of the apparatus of FIG. 1.

FIGS. 1 and 2 illustrate a preferred apparatus of the present invention, including two tobacco batch forming and processing systems, each including a batch forming chamber, and vertical and horizontal conduits which cooperate to simultaneously form, process, and load two tobacco batches onto a spool for subsequent impregnation with an expansion agent. In the following, one of the tobacco batch forming and processing systems is described in detail although it will be understood that two substantially identical systems are provided as seen in FIGS. 1 and 2.

Figure 3:
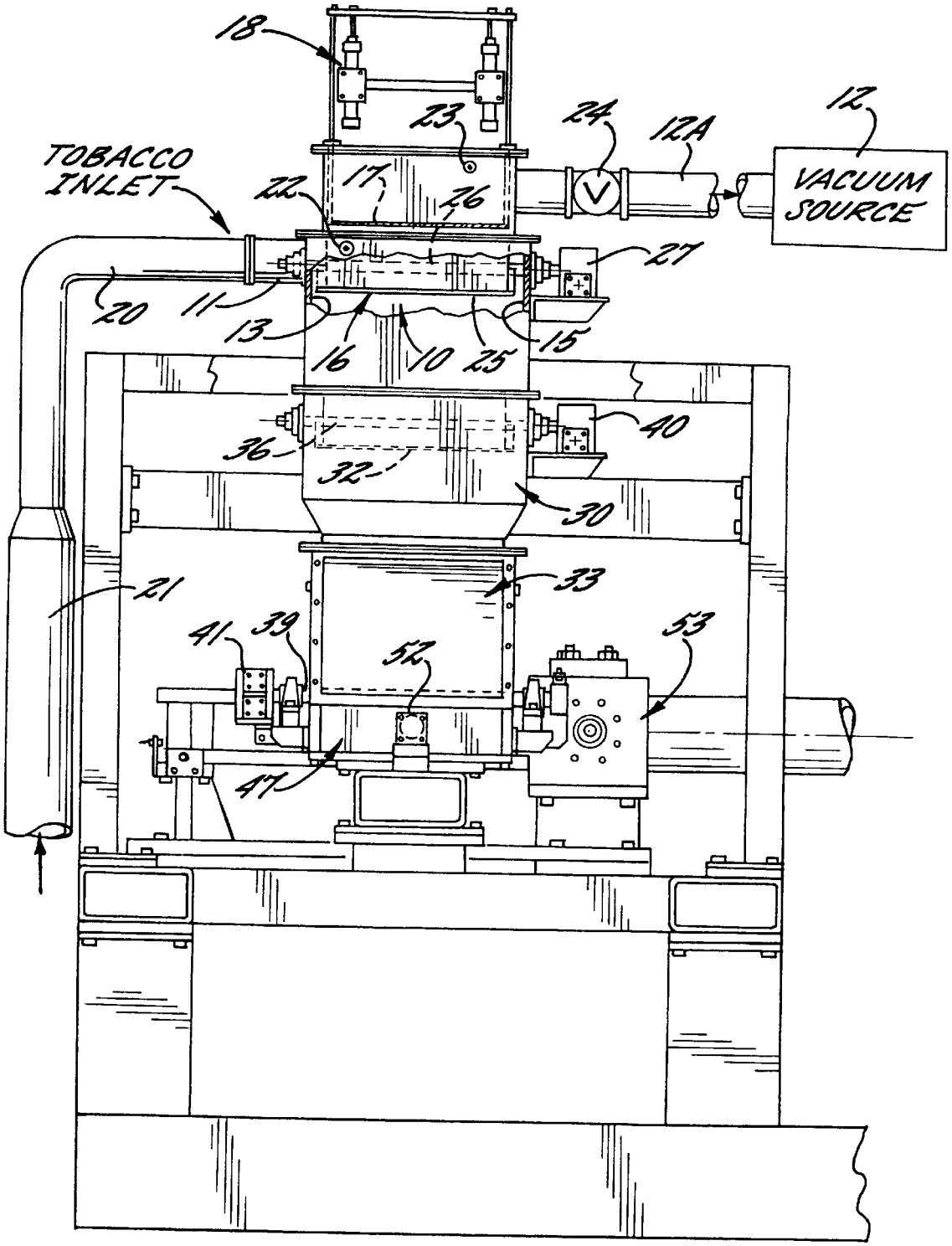
FIG. 3 is a side elevation view taken along lines 3—3 of FIG. 2 and illustrates a preferred tobacco batch forming chamber of the invention.

FIG. 3 illustrates a preferred tobacco batch forming apparatus. Tobacco in any of various forms including the form of leaf (including stem and veins), strips (leaf with the stem removed), cigar filler, cigarette cut filler (strips cut or shredded for cigarette making), mixtures of the above, scrap tobacco and tobacco shorts, etc., and preferably cut filler tobacco, is delivered to the tobacco batch forming chamber 10 through a tobacco inlet or conveyor 11. Prior to delivery into the batch forming chamber 10, the tobacco is preferably first treated by any of various means known to those skilled in the art (not shown) to increase its moisture content to a value of at least about 13% by weight, preferably at least about 16 percent by weight, and more preferably above about 20 percent by weight. When cut filler is treated in accord with the invention, the cut tobacco which is normally moistened to enhance cutting can be directly used in the invention or treated to further increase moisture. The moistened tobacco is then delivered to the tobacco batch forming chamber 10 by any conventional means, but in the most preferred embodiment is pneumatically delivered through the tobacco inlet 11 under pressure generated by a vacuum source 12.

The tobacco batch forming chamber 10 includes a substantially vertical inlet wall 13, through which the tobacco inlet 11 communicates with tobacco batch forming chamber 10, and a substantially vertical abutment wall 15, which is spaced horizontally from the vertical inlet wall 13. The tobacco is delivered to the batch forming chamber 10, preferably by a pneumatic conveyor, and enters the chamber 10 through tobacco inlet 11 under the pressure of the vacuum source 12, which provides sufficient force to propel the tobacco across the chamber, causing the tobacco to accumulate against abutment wall 15.

The tobacco batch forming chamber 10 further includes a chamber closure member 16 which forms the bottom wall of the tobacco batch forming chamber, and an adjustable screen 17 which forms the top wall of the chamber. Although gas permeable to allow the ready passage of air therethrough, the screen 17 is of sufficiently fine mesh to prevent the passage of tobacco and thus provides an upper barrier preventing exit of the tobacco from the batch forming chamber 10. Thus, the tobacco being delivered through inlet 11 will contact the abutment wall 15 and accumulate adjacent the wall 15 below the screen 17. In the most preferred embodiment, the screen 17 is provided as an upper barrier to the tobacco batch because the screen-like configuration permits the air pressure created by the vacuum source 12 to exit the batch forming chamber through the vacuum source 12 while the tobacco is maintained below the screen 17. However, other aperatured or foraminous members which permit air to exit while maintaining the tobacco within the chamber 10 can alternatively be used to provide an upper barrier as will be apparent.

The screen 17 is adjustable in its vertical position, and thus can be moved to different vertical positions and thereby define a different volume for the tobacco batch forming chamber 10 and thus for tobacco batches formed therein. This is particularly advantageous in light of the fact that different tobaccos, e.g., cut filler, leaf, cigar tobacco etc., can have different densities and packing characteristics. The adjustable barrier 17 for the chamber 10 thus allows variations in tobacco types as well as variations in processing needs to be readily accommodated in the formation of different sized tobacco batches.

The position of the screen 17 is advantageously adjusted by means of a vertical position adjustor 18 which, in the most preferred embodiment, comprises a vertical drive associated with a control for actuating the drive according to a predetermined set of instructions. The predetermined set of instructions can be based on the density of the tobacco being processed, processing variables and the like. While an automated position adjustor 18 is depicted in the drawings, the present invention is not limited to this precise configuration and other means of adjusting the vertical height of the adjustable screen 17, such as, for example, a mechanically adjustable gear or the like can readily be used in the invention as will be apparent.

To ensure a consistent and substantial flow of moistened tobacco through the pneumatic conveying tube supplying tobacco inlet 11, the tobacco inlet tube or conveyor 11 is advantageously provided with separate portions of differing diameter, including a first portion 20 and a second portion 21. The first portion is associated with the tobacco inlet 11 at tobacco inlet wall 13 and the second portion 21 of inlet tube 11 is located at or near the tobacco supply from which the tobacco is retrieved. The diameter of the second portion 21 is larger than the diameter of the first portion 20 to provide a somewhat increased vacuum therein which ensures that tobacco feed is consistently picked up and supplied to the tobacco inlet 11 by the second portion 21 of the conveyor 11. In a preferred embodiment, the smaller conveyor tube portion 20 can have a 4 inch diameter while the larger conveyor tube portion 21 can have a 5 inch diameter to provide a tobacco flow rate of 3 lbs of tobacco every 5 seconds. In general, this inlet tube arrangement reduces the amount of force used to convey the tobacco while achieving a relatively high conveying rate and also minimizes the pressure drop, i.e., pressure differential, used to convey the tobacco. In turn, this reduces compression of the tobacco while it is being conveyed which improves the consistency of the tobacco batches. On the other hand, if the tobacco is conveyed at a relatively slow rate with a relatively high pressure drop, the force of the conveying air can cause the tobacco to be compressed which produces a higher density in the tobacco batches, thus interfering with the formation of consistent sized tobacco batches.

Operation of the tobacco batch system of FIGS. 1 and 3 is initiated by the delivery, under the pressure provided by the vacuum source 12, of tobacco to the batch forming chamber 10 via tobacco inlet 11 through inlet wall 13. The tobacco entering chamber 10 is constrained vertically by the adjustable screen 17 and is horizontally constrained by the abutment wall 15. Under the pressure of the vacuum source 12, the tobacco is delivered in a flow direction transverse to the abutment wall 15 such that it accumulates horizontally in the tobacco batch forming chamber 10. A position sensor 22 detects when a predetermined amount of tobacco has been received within tobacco batch forming chamber 10.

In one embodiment of the invention, the sensor 22 is positioned to detect when the horizontal accumulation of tobacco against the abutment wall 15 has reached a predetermined distance from the abutment wall 15. Since the side, upper, and lower walls of the chamber 10 are fixed, the predetermined distance defines the volume of the tobacco batch. While any conventional position sensor 22 can be utilized, in one preferred embodiment one or more optical sensors, e.g., a light source and photocell detector, are provided in optical alignment on opposed sides of, or above and below, the chamber 10, at the predetermined distance. In another advantageous embodiment, a proximity detector in the form, e.g., of a capacitance sensor, can be provided at the predetermined location along a wall, and/or the top or bottom of the chamber 10 to detect the predetermined horizontal accumulation of tobacco against the abutment wall 15.

Alternatively, or in addition to the position sensor 22, a pressure sensor 23 can be used to detect accumulation of the predetermined amount of tobacco in the batch forming chamber 10. Sensor 23 is preferably a pressure detector which detects a predetermined pressure differential between a location above the adjustable screen 17 and a location below the screen 17. As tobacco accumulates against abutment wall 15 an increasing portion of the screen 17 becomes covered. The pressure differential across the screen 17 thus increases as more tobacco accumulates in the chamber 10. Accordingly, the pressure differential reaches the predetermined setting when a predetermined amount of tobacco has accumulated in the chamber 10.

When either or both sensors 22 and/or 23 have detected the formation of the predetermined tobacco batch size within the batch forming chamber 10, a pneumatic valve 24 located in vacuum line 12A is closed which causes termination of tobacco delivery to the chamber 10. The chamber closure member 16, which is maintained in its closed position during the chamber filling operation is then moved to an open position thereby forming a port in the bottom wall of the chamber 10 which releases the tobacco batch from chamber 10. The chamber closure member 16 is preferably a planar wall member 25 which pivots about a pivot point 26 although differing constructions can be used as will be apparent.

Advantageously, the chamber closure member 16 is operated by an actuator 27 (FIG. 2), which is connected to a control 28, which in turn is connected to one or both of sensors 22 and/or 23 and to an actuator for pneumatic valve 24. Alternatively, the chamber closure member 16 and valve 24 can be operated manually in response to signals from one or both of sensors 22 and/or 23. Actuator 27, best seen in FIG. 3, moves the chamber closure member 16 from a closed position forming the bottom of the batch forming chamber 10, as is shown in cross-section in FIG. 4, to an open position which is best illustrated in FIG. 1. In the preferred embodiment in which the actuator 27 communicates with the sensor 22, and/or 23 via control 28, the control 28 can be a series of pneumatic or electrical switches, or can be a microprocessor provided with a predetermined set of instructions for initiating operation of the closure member actuator 27 and valve 24.

Figure 4:
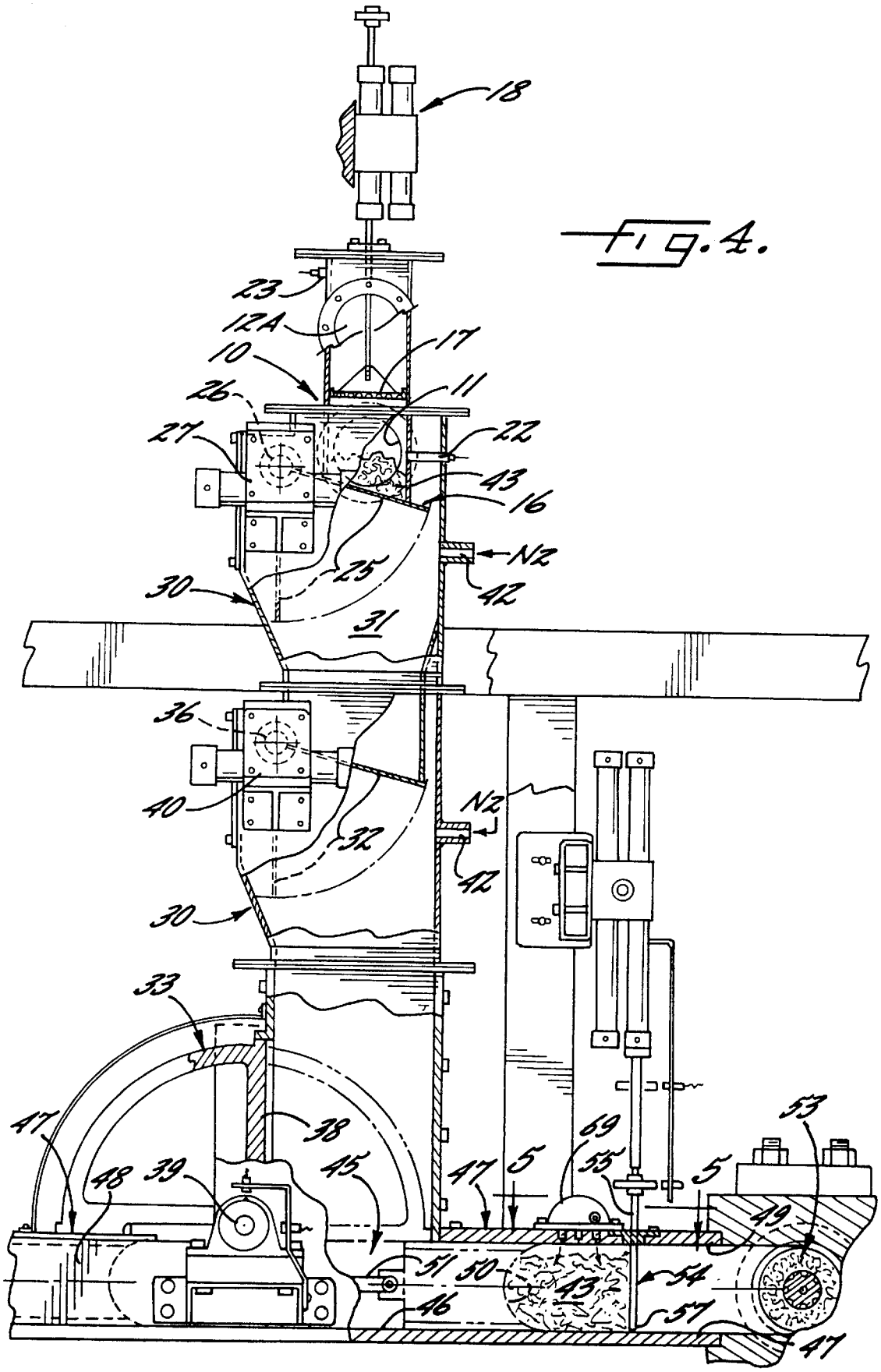
FIG. 4 is an enlarged, partially broken away side elevation view of vertical and horizontal tobacco delivery conduits located below the batch forming chamber shown in FIG. 3 and illustrates the pneumatically separable zone within the vertical conduit for preventing escape of the gaseous expansion agent from the impregnation zone into the batch forming chamber, and also illustrates the loading member within the horizontal conduit, shown at a precompaction position.

Located below the batch forming chamber is a vertically oriented conduit 30 which comprises a separable zone 31 defined between the closure member 16 and a conduit sealing member 32 (FIG. 2). The conduit 30 also includes a closure member associated with its bottom end, in the form of a conduit closure member 33. The conduit sealing member 32 can be substantially similar in configuration to the chamber closure member 16 and is preferably a substantially planar member which pivots about a pivot point 36 between a closed position in which the conduit is generally sealed, although typically not pneumatically sealed, and an open position in which the conduit is open. The conduit closure member 33 pivots upwardly to provide a port or exit for the tobacco batch from the lower end of the vertical conduit 30, and pivots downwardly to close the lower end of the conduit. Preferably the conduit closure member 33 also functions to compact tobacco exiting the vertical conduit 30, as discussed later. As best seen in FIGS. 1 and 4, the conduit closure member 33 comprises a flat planar surface 38 which pivots about pivot point 39. The conduit sealing member 32 and the conduit closure member 33 are preferably operated by actuators 40 and 41, respectively.

The conduit sealing member 32 and the conduit closure member 33 are advantageously operated in cooperation with one another. The conduit sealing member 32, when in its closed position, receives a tobacco batch released from the batch forming chamber 10, and temporarily supports the tobacco batch within vertical conduit 30. While the tobacco batch is being released from the batch forming chamber 10 via the chamber closure member 16, and for a short time thereafter, both the conduit sealing member 32 and the conduit closure member 33 are maintained in their closed positions, thereby forming dual physical barriers to the passage of any expansion agent upwardly into the batch forming chamber 10. Subsequently, when the chamber closure member 16 has returned to its closed position, the conduit closure member 33 is moved to an open position and then the conduit sealing member 32 is moved to its open position which releases the tobacco batch supported thereon into the vertically oriented conduit 30. The tobacco batch then falls past the now open conduit closure member 33, and out of the vertically oriented conduit 30.

An inert gas, such as nitrogen is emitted through ports 42 to blanket the generally sealed portion of the vertical conduit 30 between the batch forming chamber closure member 16 and the conduit sealing member 32 when both are closed. The nitrogen gas blankets the separable zone and because it is admitted under positive pressure and is a lighter gas than propane, it forms a gaseous barrier within the separable portion of the vertical conduit 30 against any tobacco expansion agent, such as propane, which may enter into the bottom of the vertically oriented conduit 30, and thus minimizes the likelihood of the expansion agent escaping upwardly through the vertical conduit and into the batch forming chamber 10.

The control 28 coordinates operation of the chamber closure member 16, the conduit sealing member 32, and the conduit closure member 33 to provide for the delivery of tobacco through the conduit 30, and the simultaneous closure of the separable zone, which in turn ensures that the propane or other expansion agent will not escape through the vertically oriented conduit 30 into the batch forming chamber 10, (at least without substantial dilution and blanketing by the inert gas) and/or into the vacuum source 12 while the tobacco batch is delivered through conduit 30. This is achieved by the coordinated operation of the three members 16, 32, 33.

With reference to FIG. 4, when a tobacco batch 43 of predetermined amount, i.e., volume or weight, has accumulated against the abutment wall 15 of the tobacco batch forming chamber 10, the sensor(s) 22 and/or 23 provide an appropriate signal to the control 28 (FIG. 2), which then stops the delivery of tobacco into the chamber 10 by initiating closure of valve 24. Advantageously the control 28 also verifies that the conduit sealing member 32 is in a closed position and then initiates the opening cycle operation of the chamber closure member actuator 27 causing the chamber closure member 16 to pivot in the downward direction about pivot point 26 thereby permitting the tobacco batch 43 to fall into the vertically oriented conduit 30.

The tobacco batch 43 then falls onto the closed conduit sealing member 32. Control 28 then initiates the closure cycle operation of the chamber closure member actuator 27 causing the chamber closure member 16 to return to its closed position thereby sealing the separable zone between the batch forming chamber closure member 16 and the conduit sealing member 32. Once chamber closure member 16 has returned to its closed position, the control 28 initiates opening of pneumatic valve 24 to thereby begin the pneumatic delivery of tobacco into the chamber 10.

While a new tobacco batch is being formed in the chamber 10 and the chamber closure member 16 is maintained in the closed position, the control 28 sends an opening signal to the actuator 40 (FIG. 3) of the conduit closure member 32 causing it to pivot downwardly about pivot point 36 and thereby permit the tobacco batch to fall downwardly and out of the separable zone 31. Prior to the opening of the conduit sealing member 32, the control 28 sends an opening signal to the actuator 41 for the conduit closure member 33 causing the conduit closure member 33 to pivot upwardly about pivot point 39 to provide an exit port 45 at the bottom of the conduit 30. The tobacco batch 43 falling from the conduit sealing member 32 exits the vertically oriented conduit 30 through port 45. The conduit sealing member 32 and the conduit closure member 33 are then returned to their closed positions whereupon a new cycle is initiated by release of a new tobacco batch from the batch forming chamber 10.

A particularly advantageous feature of this tobacco batch forming and feeding sequence is that this particular combination not only maintains the tobacco expansion agent below the vertically oriented conduit, but it also improves the distribution of the tobacco and the density uniformity within the tobacco batch. When the tobacco batch falls through the vertically oriented conduit 30 and impacts the planar surface of the conduit sealing member 32 under the force of gravity, the resultant forces within the tobacco batch cause it to spread more or less evenly on the surface of the conduit sealing member 32. The distribution of tobacco within tobacco batch is further normalized as it subsequently falls out of the separable zone 31, through the port 45 of the vertical conduit, and then impacts on the lower wall 46 of a horizontal conduit 47.

In the above-described embodiment, the coordinated operation of the various steps and apparatus for forming and transporting tobacco batches, including operation of the pneumatic conveyor, the chamber closure member, the conduit closure member, and the conduit closure member have been described in the context of a single integrated control. However, it will be apparent that different and widely varying controls can be used in the invention. For example, the coordination of the process steps and apparatus control can involve individual controls, can be coordinated with upstream or downstream operations or conditions, and/or mechanical controls can be implemented if desired.

Located below the vertically oriented conduit 30 is the tobacco batch receiving zone 44 of horizontal conduit 47. The conduit 47 is substantially defined by sidewalls 48, a lower wall 46, and an upper wall 49. A loading member 50 having a concave, semi-cylindrical face, (best illustrated in FIG. 4), is positioned within the horizontal conduit 47 for axial movement within the horizontal conduit 47 to move the tobacco batch in the receiving zone 44 along the lower wall 46 of the horizontal conduit. The loading member 50 is operatively connected by a rod 51 to a reciprocating force means such as a hydraulic piston 52 or the like for cyclic movement along a path between fully retracted and fully extended positions. In its fully retracted position, the loading member 50 is positioned upstream of the tobacco batch receiving zone 44. In its fully extended position, the loading member 50 is positioned adjacent a spool 53 of a tobacco impregnation apparatus for loading of the tobacco batch onto the spool 53.

Port 45, which communicates between the vertical conduit 30 and the horizontal conduit 47, advantageously extends transversely across the full width of the horizontal conduit 47 so that the tobacco batch fed to the receiving zone 44 is distributed substantially uniformly across the width thereof. After the tobacco batch is delivered to the receiving zone 44, the conduit closure member 33 pivots closed. If the height of the tobacco batch exceeds that of the horizontal conduit 47, the conduit closure member 33 will compress the tobacco batch into the space within the horizontal conduit 47 as it moves into its closed position.

A gas permeable barrier 54 in the form of a plurality of parallel, closely spaced tines 55 is retractably positioned within the horizontal conduit 47 between the receiving zone 44 and the spool 53. The tines 55 are received in a plurality of apertures 56 (best seen in FIG. 6), extending through the upper wall 49 of the horizontal conduit 47, and are mounted for reciprocal movement between a retracted position outside of the conduit and a barrier position 57 within and extending transversely across the conduit 47. When in its barrier position, the permeable barrier 54 prevents forward movement of the tobacco batch along the horizontal conduit 47. In addition the permeable barrier 54 also preferably forms a compressing surface which cooperates with the loading member 50 to provide precompression of the tobacco batches moved along the horizontal conduit 47 by the loading member 50. The closely spaced tines 55 which form the permeable barrier 54 in preferred embodiments of the invention provide a barrier for the tobacco batch, yet permit air pressure created by the moving loading member 50 to exit the horizontal conduit 47.

Figure 6:
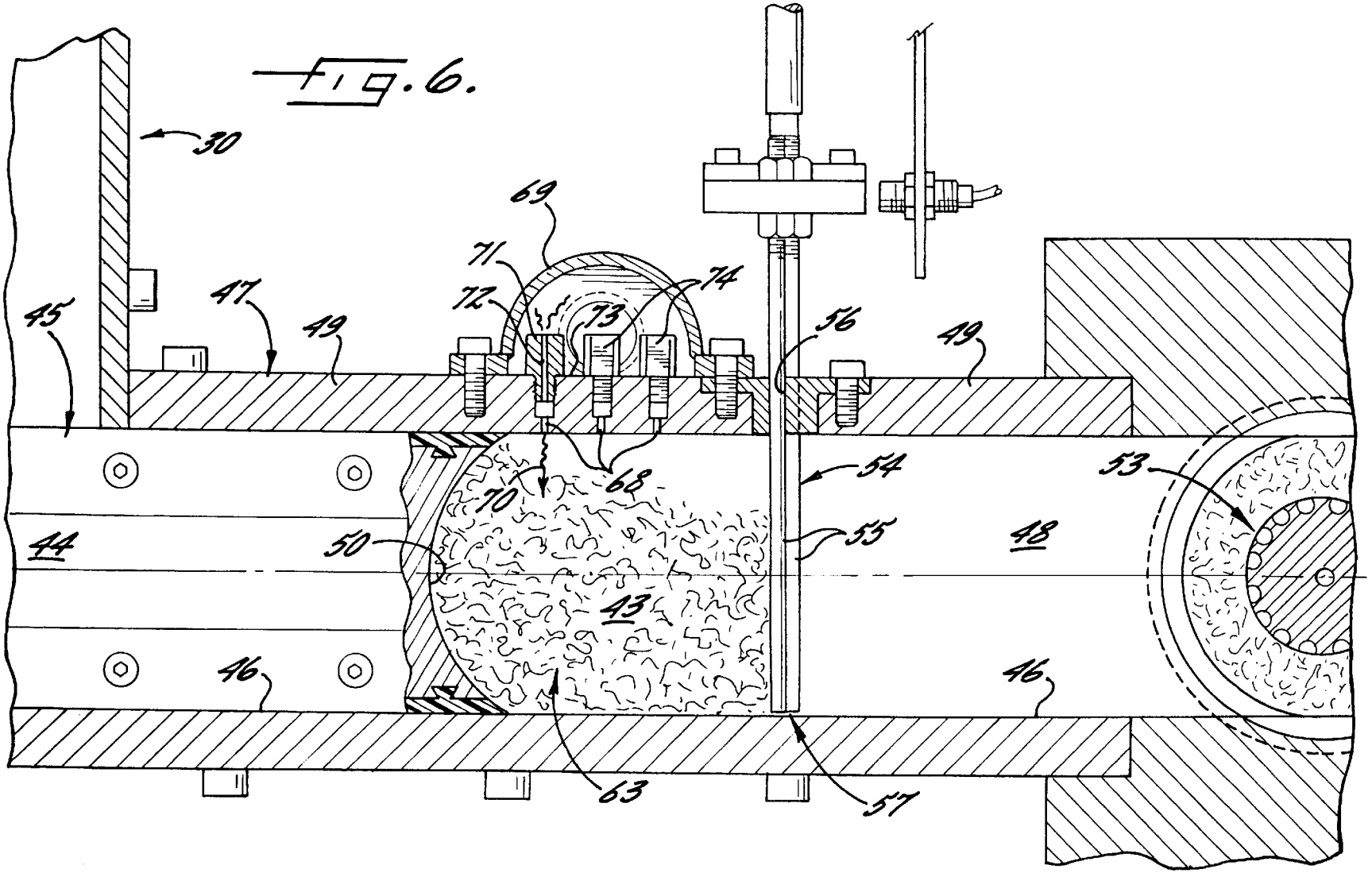
FIG. 6 is a partially broken away cross-sectional view of FIG. 5 taken along lines 6—6 illustrating a precompacted tobacco batch positioned between the loading member and the permeable tobacco barrier which is adjacent a loading position at which the tobacco batch is subsequently loaded onto a reciprocating spool body forming a portion of a tobacco impregnation apparatus, and also illustrates preferred condensation blocking plugs positioned over apertures within a steam manifold located above the tobacco precompaction zone.

As best illustrated in FIG. 6, a tobacco heating zone 63 is provided in the horizontal conduit 47 upstream of and adjacent the permeable barrier 54. A plurality of steam injecting ports 68 are provided through the upper wall 49 of the horizontal conduit 47 within the heating zone 63. These ports permit steam shown generally by arrow 70 to be injected into the heating zone to rapidly heat and moisten a tobacco batch 43 while it is positioned in the heating zone 63, and preferably maintained in a compressed state between the loading member 50 and the tines 55. Each of the steam ports 68 advantageously communicates with a steam manifold 69, located above the tobacco heating zone, via a condensate blocking plug 71 comprising a longitudinally passage 72. As seen in FIG. 6, the condensate blocking plug 71 and its longitudinally passage 72 extend upwardly above the lower surface 73 of the steam manifold 69 to permit steam to pass through the condensate blocking plug 71 while preventing any liquid condensation on the lower surface 73 of the steam manifold 69 from entering into the heating zone 63. The walls of the steam manifold 69 are also advantageously configured to prevent condensation from passing through the steam ports. As seen in FIG. 6, the manifold extends in a dome-like fashion above the heating zone so that any condensation forming on the manifold wall, will be carried downwardly along the dome-like wall and will thus not drip onto the open passages in the condensate blocking plugs 71.

The use of steam for heating of the tobacco batch in the heating zone 63 is particularly advantageous because heat can be effectively transferred to a tobacco batch during a time of only a few seconds or even less. This is particularly the case when the tobacco batch is maintained in a relatively small zone in a compressed state. At the same time the moisture level of the tobacco can also can be increased by the steam in an added moisture amount up to about 2 to about 4 percent by weight. The temperature of the steam injected is sufficient to heat the tobacco to a temperature above ambient temperature, preferably above about 150° F., more preferably a temperature of above 175° F., e.g., to a temperature of 150° to about 200° F.

Figure 5:
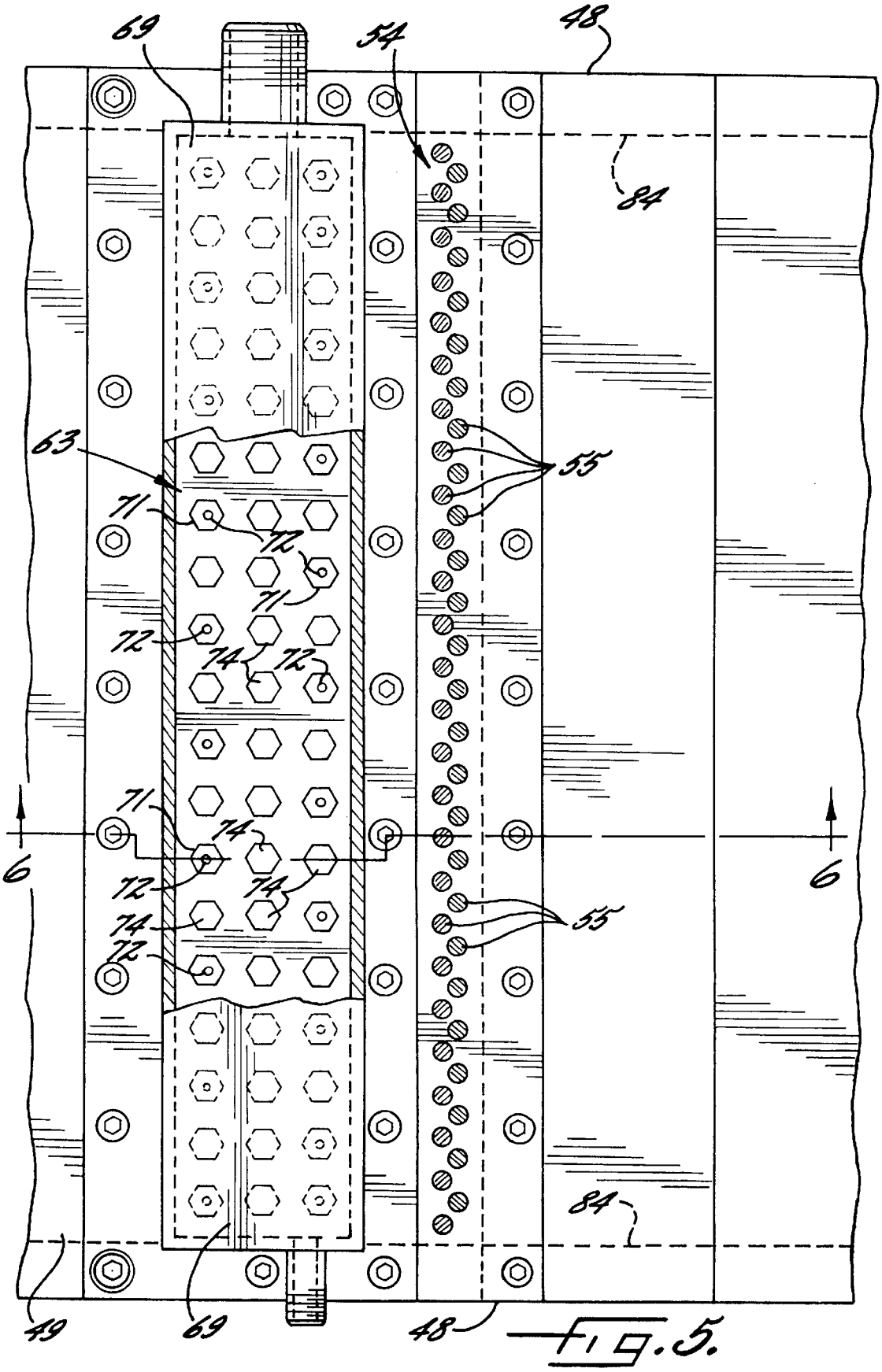
FIG. 5 is a partially broken away plan view taken along lines 5—5 of FIG. 4 illustrating a preferred arrangement of apertures within a steam manifold for evenly injecting steam into a precompacted tobacco batch and also illustrates a plurality of closely spaced tines shown in cross-section which move into and out of the horizontal conduit for providing a permeable tobacco barrier.

Because preferred expansion processes used in the present invention can readily expand tobacco of different and various densities, and different batch sizes, it can be advantageous to vary the size of the heating zone, and/or the rate at which heat is added to the heating zone on a unit volume (based on the heating zone volume) basis. This can be accomplished in one embodiment of the invention by employing a plurality of steam injecting ports 68 which are distributed in a grid-like fashion and which are constructed so that they can be selectively covered by a barrier such as an obstructing plug 74 shown in FIG. 5. The obstructing plugs 74 are provided to prevent steam from entering preselected ones of the ports. This allows less steam and or heat to be applied to a less dense or smaller volume tobacco batch. FIG. 5 depicts a top plan view of one advantageous steaming port configuration within upper wall of the heating zone 63. As shown in FIG. 5, several steaming ports contain obstructing plugs 74, while others contain condensate blocking plugs 71. While a grid-like port configuration is depicted in FIG. 5, and individual obstructing plugs 74 are illustrated, it will be apparent that numerous different configuration of ports, and various arrangements for selectively blocking or separately feeding steam to selected single ports or groups of ports can be used.

The steaming ports 68 can have various diameters but preferably are a predetermined size to control the velocity and quantity of the impregnating steam. In the preferred embodiment, wet steam, at low pressure, e.g. 15 psi, is used and the ports are configured to emit the wet steam under sufficient velocity to rapidly increase the tobacco temperature to between about 125° F. about 200° F. as discussed above. In certain situations when maximum tobacco expansion is not required, the tobacco batches may not need additional moisture and/or heating. In such instances, the steaming step can be eliminated.

Preferably, the walls of the horizontal conduit are heated by heating elements 82, best depicted in FIG. 1, in order to prevent condensation formation in or around the tobacco batch. In order to achieve consistent tobacco expansion at a desirably high level, the moisture added to the tobacco is advantageously distributed through the tobacco in a relatively uniform manner. However liquid condensate is believed to be absorbed and concentrated in small areas of the tobacco, and thus the exposure of the tobacco to liquid condensate is preferably avoided.

Preferably, the horizontal conduit 47 has a substantially rectangular cross-section and is formed of a material, such as hardened aluminum, which can withstand wear associated with the repeating horizontal movement of the loading member 50. The side walls 48 of the horizontal conduit 47 are provided with a force-bearing surface 84 of a material which produces a surface upon which the loading member 50 may readily move without wearing the more costly and friction-causing surface of the horizontal conduit. Surface 84, in a preferred embodiment, is formed of a hardened plastic to provide lubrication between the interior walls of the horizontal conduit and the exterior surface of the loading member and to prevent buckling or jamming of the loading member. Exemplary materials used to form the force bearing surface 84 include polyetheretherketone (PEEK), available from ICI Americas, Inc., and RTP Co.

In operation, the loading member 50 is moved in the direction towards the spool 53 upon closure of the compacting member 33, to move the tobacco batch axially along the horizontal conduit 47. Prior to or during initial movement of the loading member 50, the tines 55 are moved into the barrier position 57 within the conduit 47. The movement of the loading member 50 is paused when the loading member 50 reaches a predetermined precompaction position, in or adjacent the heating zone, spaced longitudinally upstream from the tines 55. The precompaction position can be varied for varying tobacco batches and is determined based on the volume, density, and make-up of the tobacco batch. Preferably the precompaction position sufficiently close to the tines 55 that the tobacco batch will occupy the entire volume between the loading member and the tines. Advantageously the tobacco can be compressed at least a small amount, e.g., 10–50% by volume against the tines 55. While the tobacco batch is maintained against the tines 55, steam 70 is injected into the tobacco batch 43 for a time sufficient to heat the tobacco.

The tines 55 are then withdrawn from the horizontal conduit 47, and the loading member 50 is once more moved axially along the conduit until it reaches its fully extended position adjacent spool assembly 53. The semi-cylindrically shaped loading member 50 cooperates in its fully extended position to form a portion of a shell around the connecting rod of the spool 53 so that the compressed tobacco is maintained on the connecting rod of the spool during its movement to an impregnating position. The spool is thus loaded with heated, moistened tobacco at the loading position as depicted in FIG. 6.

Preferably, the movement of the loading member, the insertion and retraction of the tines, and the delivery of steam into the manifold, are coordinated and controlled by a control means comprising a predetermined set of instructions to achieve the process as previously set forth. It will be apparent that different and widely varying controls can be used in the invention, as discussed previously.

The invention has been described in considerable detail with reference to preferred embodiments. However, many changes, variations, and modifications can be made without departing from the spirit and scope of the invention as described in the foregoing specification and defined in the appended claims.

That which is claimed:

1. A tobacco expansion apparatus for batch processing comprising:

a tobacco batch forming chamber;

a horizontally extending conduit defined by side walls and an upper and a lower wall, said conduit having a first portion in operative communication with said batch forming chamber to periodically receive individual batches of tobacco from said chamber;

a permeable barrier operatively associated with said conduit and being mounted for movement between a retracted position outside of said conduit and a barrier position within and extending transversely across said conduit at a location between said first portion of said conduit and a second end of said conduit;

a loading member arranged to move said individual tobacco batches along axially adjacent first and second paths within said horizontal conduit toward the second end thereof;

said first path extending between said first portion of said conduit and a predetermined precompaction position longitudinally spaced from said barrier position, said space between said precompaction position and said barrier position defining a precompaction zone;

said second path extending from said precompaction position to a position adjacent said second end of said conduit; and at least one aperture through a wall of the conduit in said precompaction zone and communicating with a source of steam for heating tobacco in said precompaction zone.

2. A tobacco expansion apparatus according to claim 1, wherein said permeable barrier is operatively connected to an actuator arranged to retract said barrier from said barrier position.

3. A tobacco expansion apparatus according to claim 2 further comprising a control connected with said actuator for said permeable barrier and comprising a predetermined set of instructions for retracting said barrier from said barrier position.

4. A tobacco expansion apparatus according to claim 1, further comprising a heater associated with said sidewalls of said precompaction zone for heating said sidewalls.

5. A tobacco expansion apparatus according to claim 1, wherein said heater is adapted to maintain the temperature of said sidewalls above about 200° F.

6. A tobacco expansion apparatus according to claim 1 wherein said apertures include a plurality of steaming ports for impregnating said tobacco with steam.

7. A tobacco expansion apparatus according to claim 6, wherein said steaming ports are a predetermined size and number to control the quantity and rate of the steam.

8. A tobacco expansion apparatus according to claim 7, wherein the velocity and quantity of the steam is sufficient to increase and maintain the temperature of the tobacco batch to at least 200° F.

9. A tobacco expansion apparatus according to claim 6, wherein a manifold extends above said steam chamber and encloses said steam ports in said upper wall of the heating zone.

10. A tobacco expansion apparatus according to claim 6, comprising at least one selectably closable steam port.

11. A tobacco expansion apparatus according to claim 6, comprising at least one condensate blocking plug configured to be inserted into said steam port which includes an opening to permit steam to enter said heating zone.

12. A process for expanding tobacco comprising the steps of:

forming a batch of tobacco comprising a predetermined amount of tobacco;

partially compacting said batch of tobacco by providing a loading member to compress said batch against a permeable barrier;

steaming said batch of tobacco while said batch is in said partially compacted condition;

removing said permeable barrier;

further compacting said batch of tobacco by moving said loading member to compress said batch into an impregnating chamber;

impregnating said batch of tobacco with an expansion agent; and subjecting the impregnated batch of tobacco to conditions sufficient to expand the tobacco.

* * * * *